US007341230B2

(12) United States Patent
Beaudry

(10) Patent No.: US 7,341,230 B2
(45) Date of Patent: Mar. 11, 2008

(54) DEVICE FOR USE TO HANG AN ARTICLE ONTO A VERTICAL STRUCTURE

(76) Inventor: Bernard Beaudry, 78 rue Breton, St-Constant, Quebec (CA) J5A 2C1

( * ) Notice: Subject to any disclaimer, the term of this patent is extended or adjusted under 35 U.S.C. 154(b) by 297 days.

(21) Appl. No.: 11/056,149

(22) Filed: Feb. 14, 2005

(65) Prior Publication Data

US 2006/0180724 A1 Aug. 17, 2006

(51) Int. Cl.
*A47G 29/00* (2006.01)
*A47K 11/08* (2006.01)

(52) U.S. Cl. ..... 248/219.4; 248/311.2; 248/315

(58) Field of Classification Search ..... 248/214, 248/219.4, 311.2, 311.3, 314–315, 230.1, 248/239, 251, 309.1, 309.2
See application file for complete search history.

(56) References Cited

U.S. PATENT DOCUMENTS 2,774,562 A * 12/1956 Henry ..... 248/125.1
3,064,933 A 11/1962 Brasty
4,300,739 A 11/1981 Sande
4,415,137 A 11/1983 Garves
4,708,309 A 11/1987 Walter
4,809,890 A * 3/1989 Tsigadas ..... 224/435
4,908,982 A 3/1990 Quatrini
5,088,672 A 2/1992 Neuendorf et al.
5,118,059 A * 6/1992 Mainer ..... 248/215
5,154,386 A * 10/1992 Heck ..... 248/230.5
5,320,319 A 6/1994 Winger et al.
5,395,081 A 3/1995 Vollink
5,469,804 A * 11/1995 Bracken ..... 114/343
5,645,255 A * 7/1997 Parduhn ..... 248/214
5,651,521 A 7/1997 Aberg
6,209,837 B1 4/2001 Harms
6,357,709 B1 * 3/2002 Parduhn ..... 248/229.17
6,375,141 B1 4/2002 Kettlestrings
6,439,522 B1 8/2002 Yeh
6,454,232 B1 * 9/2002 Roth ..... 248/228.1
6,581,896 B1 6/2003 Olexovitch
2006/0180724 A1 * 8/2006 Beaudry ..... 248/219.4
2006/0284040 A1 * 12/2006 Nixon et al. ..... 248/311.2

* cited by examiner

*Primary Examiner*—Carl D. Friedman
*Assistant Examiner*—Tan Le
(74) *Attorney, Agent, or Firm*—Robic

(57) ABSTRACT

Disclosed is a device removably attachable to a vertical rod-like structure to hang articles such as flower pots. The device has a main body on which the article to be hang can be attached and a U-shaped bracket. In use, the main body and the U-shaped bracket are assembled in such a manner as to surround the rod-like structure. The article to be hung once attached, generates a cantilever action that presses the main body against the rod-like structure and causes the device to lock on the structure. Advantageously, the rear part of the main body is carved in a stepwise manner in order to fit rod-like structures of different sizes and shapes. The device may also be advantageously used with interchangeable supports for use to hang articles of different sizes and shapes. The device and the support are easy to use and can be installed without tools.

12 Claims, 5 Drawing Sheets

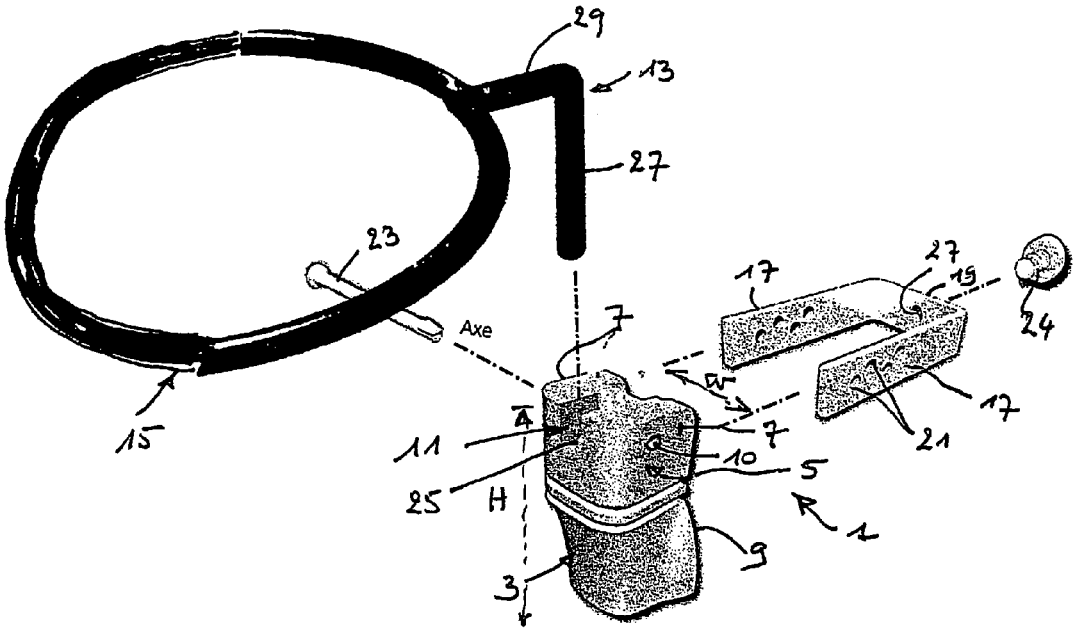
Fig - 1
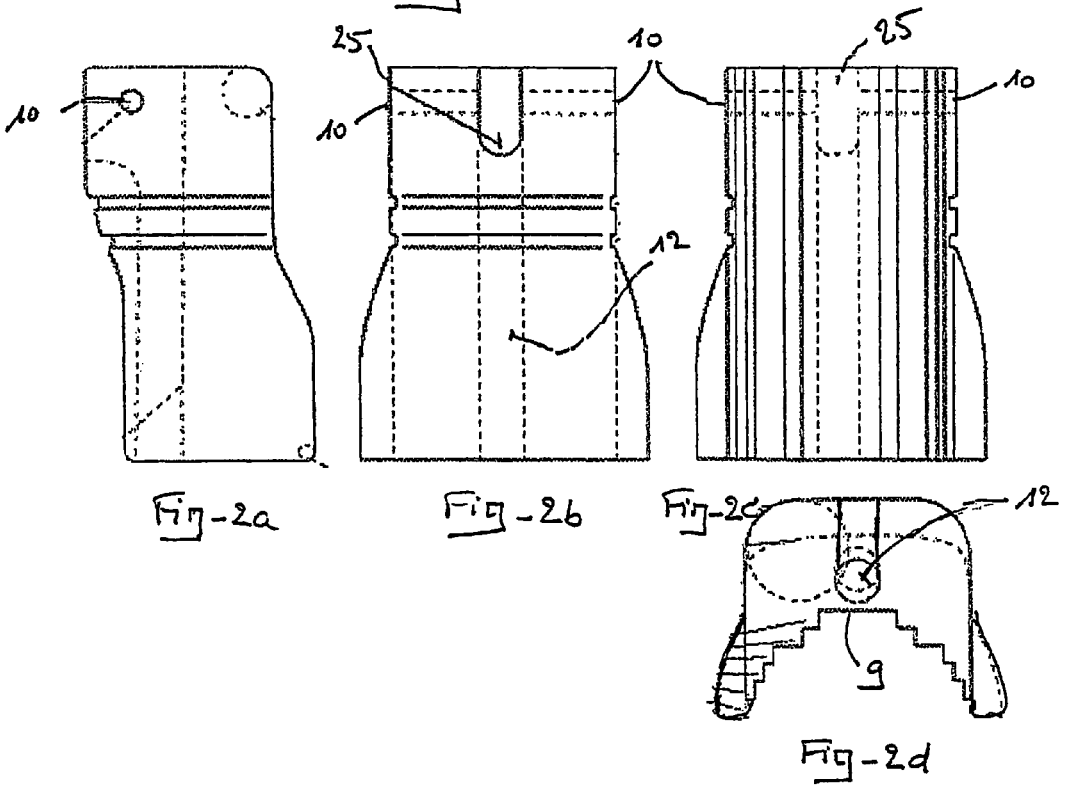
Fig-2a Fig-2b Fig-2c
Fig-2d

DEVICE FOR USE TO HANG AN ARTICLE ONTO A VERTICAL STRUCTURE

FIELD OF THE INVENTION

This invention relates to a device for use to hang an article onto a vertical structure.

More specifically, the invention relates a device removably attachable to a vertical rod-like structure such as a railing or a vertical baluster, in order to hang onto this structure a flower pot, a flower box, a platter, or a decorative article like a bird house or a flag.

DESCRIPTION OF THE PRIOR ART

Devices of the above-mentioned type for use to attach horticultural products to vertical rods are known.

By way of example, U.S. Pat. No. 2,774,562 (HENRY) describes a device for hanging an article, preferably a flower pot on a column, which comprises a rectangular bracket devised to engage the column in such a manner as to provide friction holding forces onto the column and thus lock the apparatus at a given height on the column once the article to be supported is attached to an extension projecting from the bracket.

U.S. Pat. No. 4,415,137 (GARVES) describes a detachable cantilever attachment device for hanging an article on a vertical post, which device is made of a single strip of steel comprising a resilient portion attached to a vertical base from which projects a cantilever member with a distal hook curved upwards. The device also comprises an attachment member which captures and holds the base against the post. The resilient portion of the strip permits to hold the device against the post when the article to be hung is attached to the cantilever member. Cams may be provided on the attachment member to provide versatility and thus allow the device to be used with posts of different thicknesses.

U.S. Pat. No. 6,209,837 (HARMS) discloses a vertical baluster bracket made of a single rod having an outer end bent to receive and hang a pot, and a inner end devised in such a way as to clamp to a baluster or vertical railing. To remain in position, the bracket relies on the friction with the vertical baluster and the weight of the bracket and load on the bracket outer end.

These known devices can be installed on railings or balusters in a quick and efficient manner without need for any additional equipment. However, none of them is actually "universal" and attachable to railings or blusters of different sizes for supporting any kind of articles.

SUMMARY OF THE INVENTION

The object of the present invention is to provide a device that is both very efficient and universal.

More particularly, the present invention is directed to a device removably attachable to a vertical rod-like structure in order to hang an article onto this rod-like structure, which device comprises:

a) a main body of a given height and a given width, which body has:

an upper portion with opposite sidewalls;

a rear side portion shaped and sized to fit onto the rod-like structure;

means in the upper portion for connecting the article to be hung to the main body in a position opposite to the rear sidewall; and at least one transversal hole extending through the opposite side walls of the upper portion;

b) a U-shaped bracket which has a pair of opposite side arms projecting from a transverse bar, the bracket being sized to fit onto the rod-like structure and have portions of its opposite side arms respectively positioned on the opposite side walls of the upper portion of the main body, the portions of the opposite side arms being each provided with a plurality of transversal holes extending at different distances from the transverse bar, the holes of one of the opposite side arms being in line with those of the other one of the opposite side arms; and c) at least one pivot pin for connecting the U-shaped bracket to the main body, the at least one pivot pin is insertable into the corresponding holes of the opposite side arms of the bracket and into the at least one transversal hole of the upper portion of the main body after the bracket has been fit onto the rod-like structure and the main body has been positioned adjacent to said rod-like structure in a position opposite to said bracket.

After insertion of the at least one pivot pin, the main body and bracket altogether surround the rod-like structure, and the article that is then hung to the upper portion of the main body generates a cantilever action that presses the rear side portion of the main body against the rod-like structure and causes the device to lock onto the rod-like structure and hang the article onto it at any desired height where is positioned the device.

Preferably, the rear side portion of the main body is of a concave cross-section all over the height of the main body and is carved in a stepwise manner in order to receive and fit onto rod-like structures of different sizes and cross-sections.

Preferably also, the means for connecting the object to be hung comprises a vertical hole which is made into the main body and opens in the upper portion thereof, and into which a leg projecting from a supporting rack may be inserted.

Preferably again, a locking pin is screwably mounted into a central hole made in the transverse bar of the U-shaped bracket.

As it can be appreciated, the device according to the present invention permits to hang any kind of articles like flower pots, flower boxes, trays, bird house, flags and the like, onto a vertical rod-like structure of any cross-section.

An advantage of the device according to the invention is that it permits for an article to be hung onto a rod-like structure at any desired height where is positioned the device.

Another advantage of the device according to the invention is that it can hold objects of a weight up to 20 kg.

The invention and its numerous other advantages will be more easily understood after reading the following non-restrictive description of a preferred embodiment thereof, made with reference to the following drawings.

BRIEF DESCRIPTION OF THE DRAWINGS

In the accompanying drawings:

FIG. 1 is an exploded perspective view of a device according to a preferred embodiment of the invention;

FIGS. 2*a*, 2*b*, 2*c* and 2*d* are side elevational, front, rear and transversal views of the main body of the device;

DESCRIPTION OF A PREFERRED EMBODIMENT OF THE INVENTION

Figure 3A:
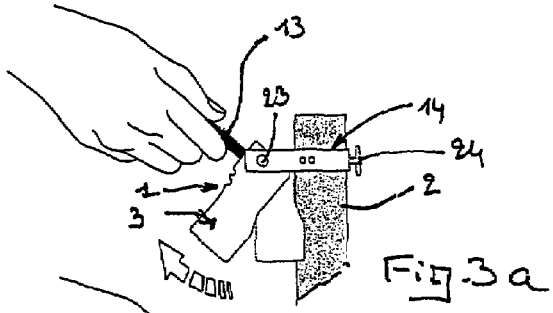
FIGS. 3*a* to 3*c* are side elevational views of a rod on which the device is to be installed, such views illustrating the steps to be followed in order to lock the device shown in FIG. 1.

In the following description and attached drawings, similar elements have been identified with similar reference numerals. Moreover, in order to simplify the drawings, some elements have not been necessarily identified to in some figures if they have already been referred to in a preceding figure.

As shown in FIG. 1, the device 1 according to the preferred embodiment of the invention for use to hang an article onto a rod-like structure 2, comprises a main body 3 of a given height H and a given width W having an upper portion 5 with opposite side walls 7, a front side portion and a rear side portion 9 shaped and sized to fit onto a rod-like structure 2 (see FIGS. 6*a* to 6*d*). Means 11 are provided in the upper portion 5 for connecting an article to be hung to the main body 3 in a position opposite to the rear side wall 9. Such an article is preferably held as a supporting rack 15 as shown and disclosed hereinafter. However, it could be adapted to be connected directly to the main body 3, if desired.

As shown in FIGS. 2*d* and 6*a* to 6*h*, the means 11 for connecting the article to be hung via the supporting rack 15 preferably comprises a vertical hole 12 which is made into the main body 3 and opens in the upper portion 5 thereof and into which a leg 13 projecting from the supporting rack 15 may be inserted.

As also shown in FIGS. 1 and 2, the main body 3 has two transversal holes 10 that extend in line through the opposite side walls 7 of its upper portion 5 and each open into the vertical hole 12.

As further shown, the upper portion 5 of the main body 3 is advantageously preferably provided with a recess 25 that extend in between part of the vertical hole 12 made into the main body 3 and part of the front side portion of the main body 3, down below the two transversal holes 10 extending through the upper portion 5 of this main body 3.

The above mentioned leg 13 projecting from the supporting rack 15 is preferably L-shaped and comprises a vertical portion 27 insertable into the vertical hole 12 made in the main body 3 and an horizontal portion 29 extending into the recess 25 made in the upper part 5 of the main body 3 after the vertical portion 27 has been inserted into the vertical hole 12.

The device 1 also comprises a U-shaped bracket 14 or 14' with a pair of opposite side arms 17 projecting from a transverse bar 19. The bracket 14 or 14' is sized to fit onto the rod-like structure with portions of its opposite side arms 17 respectively positioned on the opposite side walls 7 of the upper portion 5 of the main body 3. The portions of the opposite side arms 17 are each provided with a plurality of transversal holes 21 extending at different distances from the transverse bar 19. The holes 21 of one of opposite side arm 17 are in line with those of the other opposite side arm 17.

As shown in FIGS. 4*a* and 4*b* and FIGS. 5*a* and 5*b*, the device 1 preferably comprises two distinct U-shaped brackets 14 and 14' which are devised to work on the same way but are of different size with holes 22 positioned at different positions, so as to allow easy adaptation of the device 1 to rod-like structures of different sizes by mere replacement of the U-shaped bracket 14 by the other U-shaped bracket 14' and vice versa.

The device 1 also has at least one pivot pin 23 for connecting the U-shaped bracket 14 to the main body 3. Preferably, use is made of a single pivot pin 23 that is insertable into the corresponding holes 21 of the opposite side arms 17 of the bracket 14 and the transversal hole 10 of the upper portion 5 of the main body 3 after the bracket 14 or 14' has been fit onto the rod-like structure 2 and the main body 3 has been positioned adjacent to said rod-like structure 2 in a position opposite to the bracket 14 or 14'. As aforesaid, the pivot pin 23 is made of one piece and is long enough to extend through the transversal holes 21 while passing through the vertical hole 12.

Figure 3B:
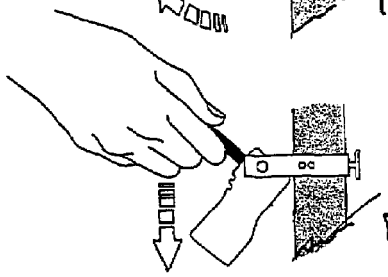
Figure 3C:
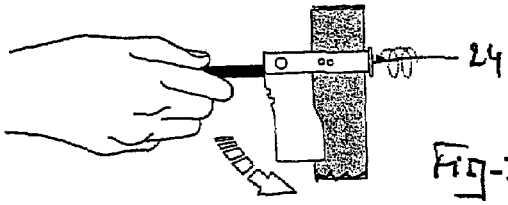
Figures 4A, 4B:
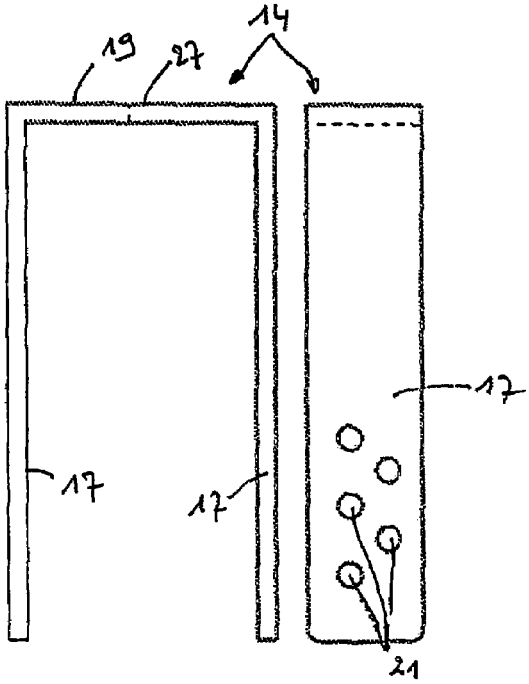
FIGS. 4*a* and 4*b* are top and side views of a U-shaped bracket of a first given size.
Figures 5A, 5B:
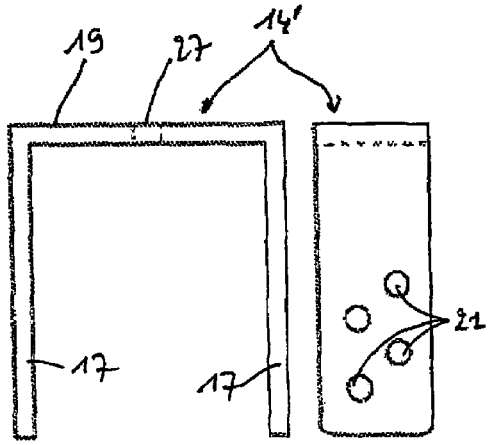
FIGS. 5*a* and 5*b* are top and side views of another U-shaped bracket of a second given size smaller than the first one, these two U-shaped brackets allowing installing the device onto rods of a large variety of sizes.
Figure 6A:
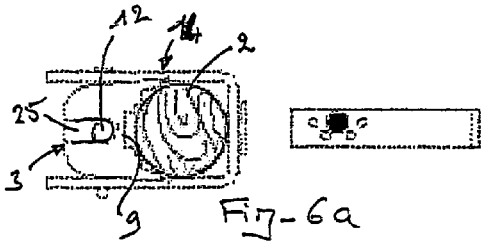
FIGS. 6*a* to 6*h* are transversal cross section views of the device shown in FIG. 1, when mounted onto rods of cross sections by means of the two different brackets shown in FIGS. 4*a* and 4*b* and FIGS. 5*a* and 5*bd;*
Figure 6B:
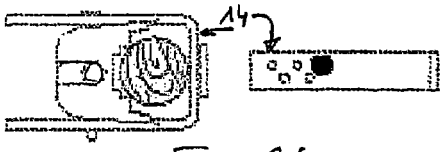
Figure 6C:
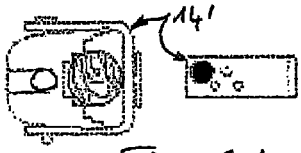
Figure 6D:
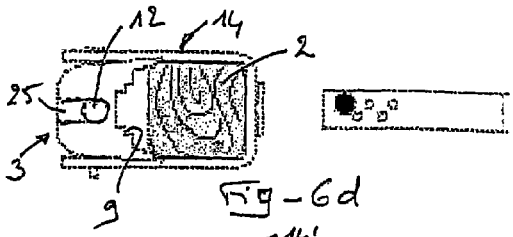
Figure 6E:
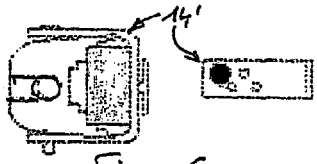
Figure 6F:
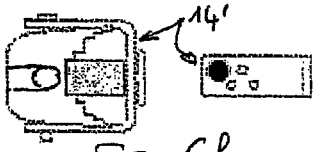
Figure 6G:
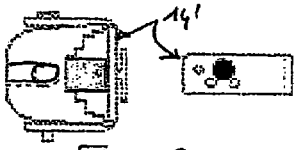
Figure 6H:
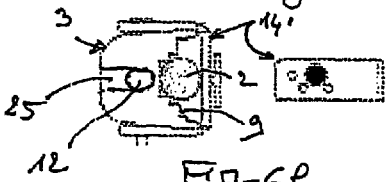

As better shown in FIGS. 3*a* to 3*c*, after insertion of the pivot pin 23, the main body 3 and the bracket 14 (or 14') altogether surround the rod-like structure 2, and the article that can then be hung to the upper portion 5 of the main body 3 generates a cantilever action that presses the rear side portion 9 of the main body 3 against the rod-like structure 2 and causes the device 1 to lock onto the rod-like structure 2 and hang the article onto the rod-like structure 2 at any desired height where is positioned the device 1.

Preferably, the U-shaped bracket 14 has a locking pin 24 screwably mounted into a central hole 27 made in the transverse bar 19 of the U-shaped bracket 14. This pin 24 once screwed (see FIG. 3*c*) makes it sure that the device 1 will remain in place and will not "slip" down, even if the rid-like structure is vibrating.

The rear side portion 9 of the main body 3 is preferably of a concave cross-section all over the height H of the main body 3. More preferably, this rear side portion 9 is carved in a stepwise manner as shown in FIGS. 2*c* and 2*d* in order to receive and fit onto rod-like structures 2 of different sizes and cross-sections, as shown in FIGS. 6*a* to 6*h*.

Figure 7:
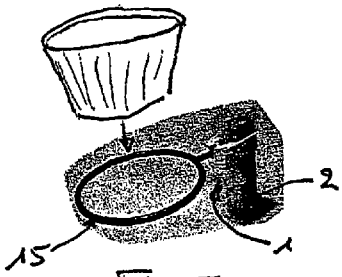
FIG. 7 is a perspective view of a supporting rack of given shape for a flower pot.

In one preferred embodiment of the invention (see FIGS. 1 and 7) the supporting rack 15 is devised and shaped to receive and hold a flower pot. In practice, the rack 15 can be of different size and shapes so as to receive corresponding flower pots that are preferably made of plastic or ceramic.

Figure 8:
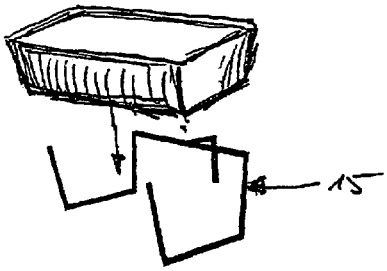
FIG. 8 is a perspective view of a supporting rack for a flower box.
Figure 11:
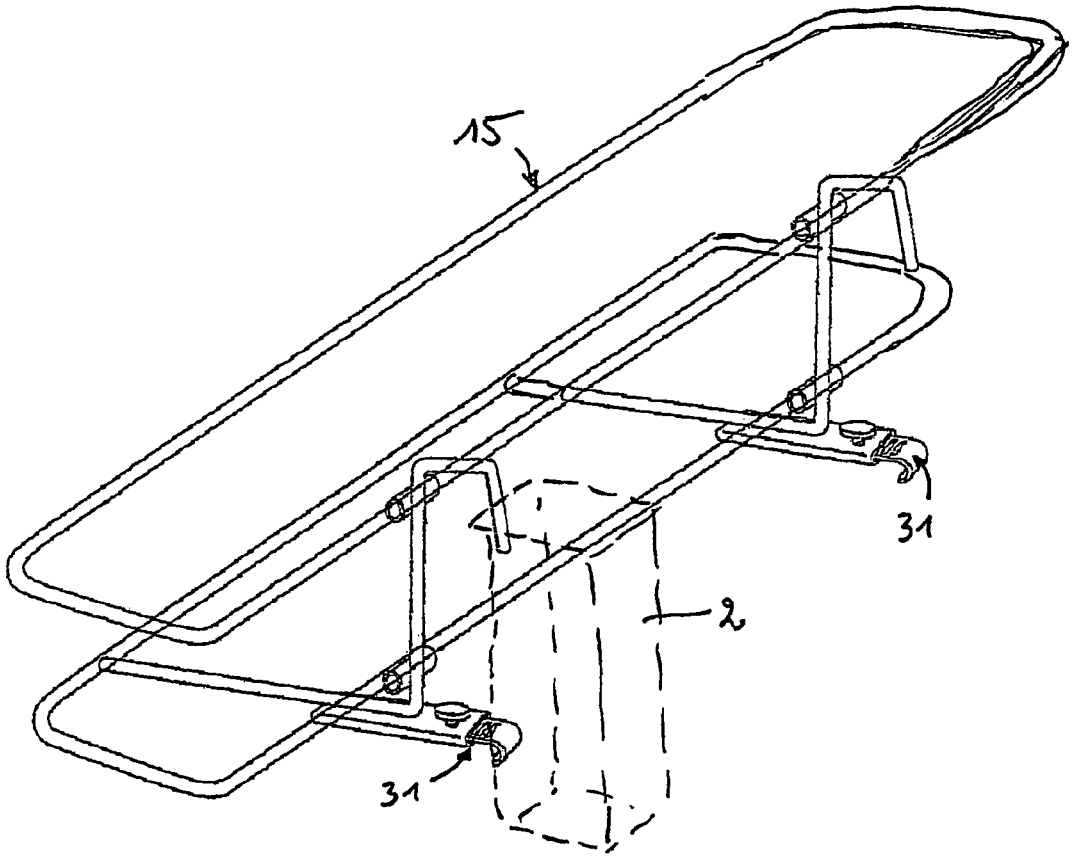
FIG. 11 is a perspective view of a support rack connectable to two devices according to the invention, for receiving a long flower box.

In another preferred embodiment of the invention, (see FIGS. 8 and 11), the supporting rack 15 is devised and shaped to receive and hold a flower box. In the embodiment shown in FIG. 8, the supporting rack is intended to be hung to only one device 1 attached to one rod like structure. In the embodiment shown in FIG. 11, the rack 15 is intended to be hung onto two devices 1 positioned at the same level onto two spaced part rod-like structures. In such a case, the rack preferably has two screwably adjustable supporting means 31 that can be adjusted to bear on the adjacent rod like structure 2 when a flower box is hung to make it sure that it extends horizontally.

Figure 9A:
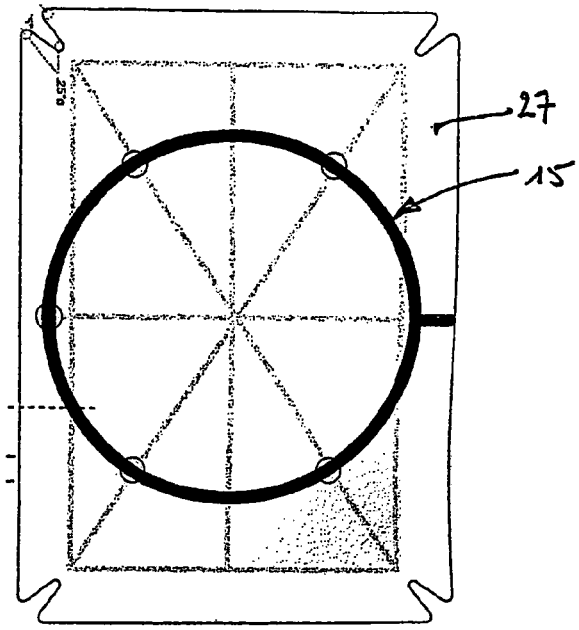
FIGS. 9*a* and 9*b* show bottom and side views of a tray held by the supporting rack shown in FIGS. 7*a* and 7*b;*
Figure 9B:
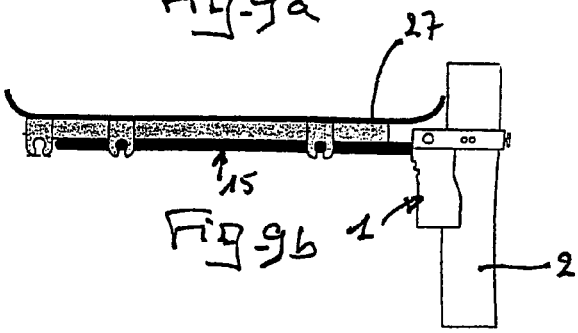
Figure 10:
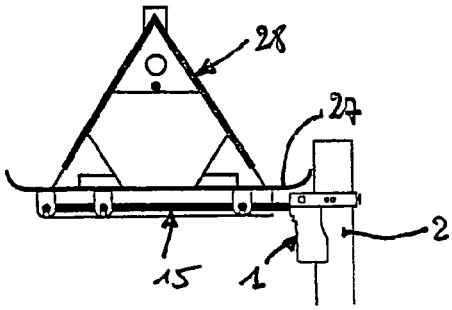
FIG. 10 is a side view of the tray shown in FIGS. 9*a* and 9*b*, on which is mounted a bird house.

In yet another preferred embodiment of the invention, the supporting rack 15 is devised and shaped to hold a tray 27 (see FIGS. 9*c* and 9*b*) or a birdhouse 28 (see FIG. 10).

In a further preferred embodiment of the invention (not shown) the supporting rack 15 is devised and shaped to hold a flag or any other article.

Preferably, the main body 3 and the U-shaped bracket 14 or 16 of the clipping device according to the invention are made of plastic material. Preferably also, the locking pin 24 is made of plastic material to prevent damage to the rod-like structure 2 to which the device 1 is attached.

Preferably also, the supporting rack 15 is made of black metal, which is compatible with almost all plastic and ceramic pots on the market. Such a rack 15 made of metal does not rust. It is washable, it does not damage the vertical rod-like structure and it resists to climatic conditions.

A first advantage of the device according to the preferred embodiment of the invention as shown in the attached drawings is that, in use, when the pivot pin 23 is inserted into the transversal holes to connect the U-shaped bracket to the main body after the L-shaped leg has been fully inserted into the vertical hole, the pivot pin 23 extends above the horizontal portion 29 of the L-shaped leg 13 and securely locks the supporting rack 15 to the device 1.

Another advantage of the device 1 according to the invention is that the supporting rack 15 can very easily be replaced by another one.

A further advantage of the device 1 according to the invention is that it does not require any tool for installation and can be installed in less than a minute.

Still another advantage of the device 1 according to the invention is that it is removably attachable to a vertical rod-like structure in order to hang an article onto it.

Still another advantage of the device 1 according to the invention is that it permits for an article to be hung at any desired height on the rod-like structure.

Still a further advantage of the device 1 according to the invention is that it is usable indoors and outdoors. It also permits for the article to be hung to be positioned in height with a simple twist.

Another advantage of the device 1 according to the invention is that it can be used on only one vertical rod-like structure.

Moreover, all its elements can be positioned outside a balcony or a staircase while reducing the risk of accidents.

As aforesaid, the device 1 according to the invention can be used to hang article weighting up to twenty (20) kilos.

The device 1 is also adaptable to any kind of rod-like structures such as balconies, staircase railings and the like. It can be used with numerous kinds of supporting racks depending on the kind of articles to be hung.

Last of all, the device 1 according to the invention is particularly advantageous in that thanks to the structure of its main body 3, it can be used to hang any kind of supporting rack 15 on any kind of rod-like structure and it is very easy to use.

In use, it is always better to remove the article to be hung from the rack 15 for better security. Prior to moving the device 1 in height on the same rod-like structure or from one vertical rod-like structure to another one, It is also better that the article to be hung be well balanced on the device.

Before using the device 1 according to the invention, it is also best to make sure that the vertical rod-like structure 2 does not have any asperities which would hinder the movement of the device. It is also better to use and screw the locking pin 24.

Of course, numerous modifications could be made to the device according to the invention as disclosed hereinabove without departing from the scope of the invention as claimed hereinafter, it being understood that all the other structural features of the above device are conventional and needs not be further described.

The invention claimed is:

1. A device removably attachable to a vertical rod-like structure to hang an article onto said rod-like structure, said device comprising:

a) a main body of a given height and a given width, said body having:
   an upper portion with opposite sidewalls;
   a rear side portion shaped and sized to fit onto said rod-like structure;
   means in said upper portion for connecting the article to be hung to said main body in a position opposite to the rear sidewall; and
   at least one transversal hole extending through the opposite side walls of said upper portion;

b) a U-shaped bracket having a pair of opposite side arms projecting from a transverse bar, said bracket being sized to fit onto said rod-like structure and have portions of its opposite side arms respectively positioned on the opposite side walls of the upper portion of the main body, said portions of the opposite side arms being each provided with a plurality of transversal holes extending at different distances from the transverse bar, the holes of one of said opposite side arms being in line with those of the other one of said opposite side arms; and c) at least one pivot pin for connecting said U-shaped bracket to said main body, said at least one pivot pin being insertable into the corresponding holes of the opposite side arms of the bracket and into said at least one transversal hole of the upper portion of the main body after the bracket has been fit onto the rod-like structure and the main body has been positioned adjacent to said rod-like structure in a position opposite to said bracket;

whereby, after insertion of said at least one pivot pin, the main body and bracket altogether surround the rod-like structure, and the article that is then hung to the upper portion of the main body generates a cantilever action that presses the rear side portion of said main body against the rod-like structure and cause said device to lock onto said rod-like structure and hang the article onto said rod-like structure at any desired height where is positioned the device, wherein the rear side portion of the main body is of a concave cross-section all over the height of said main body and is carved in a stepwise manner in order to receive and fit onto rod-like structures of different sizes and cross-sections.

2. A device removably attachable to a vertical rod-like structure to hang an article onto said rod-like structure, said device comprising:

a) a main body of a given height and a given width, said body having:
   an upper portion with opposite sidewalls;
   a rear side portion shaped and sized to fit onto said rod-like structure;

means in said upper portion for connecting the article to be hung to said main body in a position opposite to the rear sidewall; and at least one transversal hole extending through the opposite side walls of said upper portion;

b) a U-shaped bracket having a pair of opposite side arms projecting from a transverse bar, said bracket being sized to fit onto said rod-like structure and have portions of its opposite side arms respectively positioned on the opposite side walls of the upper portion of the main body, said portions of the opposite side arms being each provided with a plurality of transversal holes extending at different distances from the transverse bar, the holes of one of said opposite side arms being in line with those of the other one of said opposite side arms; and c) at least one pivot pin for connecting said U-shaped bracket to said main body, said at least one pivot pin being insertable into the corresponding holes of the opposite side arms of the bracket and into said at least one transversal hole of the upper portion of the main body after the bracket has been fit onto the rod-like structure and the main body has been positioned adjacent to said rod-like structure in a position opposite to said bracket;

whereby, after insertion of said at least one pivot pin, the main body and bracket altogether surround the rod-like structure, and the article that is then hung to the upper portion of the main body generates a cantilever action that presses the rear side portion of said main body against the rod-like structure and cause said device to lock onto said rod-like structure and hang the article onto said rod-like structure at any desired height where is positioned the device, said device further comprising a locking pin screwably mounted into a central hole made in the transverse bar of the U-shaped bracket.

3. A device removably attachable to a vertical rod-like structure to hang an article onto said rod-like structure, said device comprising:

a) a main body of a given height and a given width, said body having:

an upper portion with opposite sidewalls;

a rear side portion shaped and sized to fit onto said rod-like structure;

means in said upper portion for connecting the article to be hung to said main body in a position opposite to the rear sidewall; and at least one transversal hole extending through the opposite side walls of said upper portion;

b) a U-shaped bracket having a pair of opposite side arms projecting from a transverse bar, said bracket being sized to fit onto said rod-like structure and have portions of its opposite side arms respectively positioned on the opposite side walls of the upper portion of the main body, said portions of the opposite side arms being each provided with a plurality of transversal holes extending at different distances from the transverse bar, the holes of one of said opposite side arms being in line with those of the other one of said opposite side arms; and c) at least one pivot pin for connecting said U-shaped bracket to said main body, said at least one pivot pin being insertable into the corresponding holes of the opposite side arms of the bracket and into said at least one transversal hole of the upper portion of the main body after the bracket has been fit onto the rod-like structure and the main body has been positioned adjacent to said rod-like structure in a position opposite to said bracket;

whereby, after insertion of said at least one pivot pin, the main body and bracket altogether surround the rod-like structure, and the article that is then hung to the upper portion of the main body generates a cantilever action that presses the rear side portion of said main body against the rod-like structure and cause said device to lock onto said rod-like structure and hang the article onto said rod-like structure at any desired height where is positioned the device, wherein said means for connecting the article to be hung comprises a vertical hole which is made into said main body and opens in the upper portion thereof and into which a leg projecting from a supporting rack may be inserted.

4. The device of claim 3, wherein the supporting rack is devised and shaped to receive and hold a flower pot.

5. The device of claim 3, wherein the supporting rack is devised and shaped to receive and hold a flower box.

6. The device of claim 3, wherein the supporting rack is devised and shaped to receive and hold a tray.

7. The device of claim 3, wherein the supporting rack is devised and shaped to receive and hold a bird house.

8. The device of claim 3, wherein the supporting rack is devised and shaped to receive and hold a flag.

9. The device of claim 3, wherein the rear side portion of the main body is of a concave cross-section all over the height of said main body and is carved in a stepwise manner in order to receive and fit onto rod-like structures of different sizes and cross-sections.

10. The device of claim 9, further comprising a locking pin screwably mounted into a central hole made in the transverse bar of the U-shaped bracket.

11. The device of claim 10, wherein said main body and U-shaped bracket are made of plastic material.

12. The device of claim 3, wherein said body and U-shaped bracket are made of plastic material.

* * * * *